US005816071A

United States Patent [19]

Pekola

[11] Patent Number: 5,816,071

[45] Date of Patent: Oct. 6, 1998

[54] DILUTION REFRIGERATOR EQUIPMENT

[75] Inventor: Jukka Pekola, Jyväskylä , Finland

[73] Assignee: Nanoway Oy, Jyvaskyla, Finland

[21] Appl. No.: 871,181

[22] Filed: Jun. 9, 1997

[30] Foreign Application Priority Data

Jun. 11, 1996 [FI] Finland ..... 962421
Feb. 3, 1997 [FI] Finland ..... 970442

[51] Int. Cl.[6] ..... F25J 1/00
[52] U.S. Cl. ..... 62/610; 62/50.7
[58] Field of Search ..... 62/610, 50.7

[56] References Cited

U.S. PATENT DOCUMENTS 5,189,880 3/1993 Frossati et al. ..... 62/610
5,440,888 8/1995 Cottevieille ..... 62/50.7
5,542,256 8/1996 Batey et al. ..... 62/610

*Primary Examiner*—Ronald C. Capossela
*Attorney, Agent, or Firm*—Fildes & Outland, P.C.

[57] ABSTRACT

Dilution refrigerator equipment, which includes a vacuum vessel with its connections, a dilution refrigerator, made essentially completely of plastic set inside it and supported from a metallic pumping tube, includes an upper still and a lower mixing chamber and a heat exchanger connecting them. The pumping tube is connected to the still of the dilution refrigerator. The tube connection of the still includes an intermediate piece, separating the metallic pumping tube from the plastic structure of the still, which is made from a mixture of plastic and metal powder, to accommodate the greatly deviating thermal expansions of the connection components to one another.

8 Claims, 2 Drawing Sheets

DILUTION REFRIGERATOR EQUIPMENT

FIELD OF THE INVENTION

This invention relates to dilution refrigeration equipment, which is arranged to be installed in a DEWAR flask through its narrow neck section and which includes a vacuum vessel with connections, a dilution refrigerator made essentially completely of plastic, comprising an upper distilling section and a lower mixing chamber and a heat exchanger connecting them, supported by a metallic pumping tube, and in which the aforesaid pumping tube is connected to the distilling section of the dilution refrigerator.

BACKGROUND OF THE INVENTION

In U.S. Pat. No. 5,189,880, Frossati has presented a completely plastic dilution refrigerator. It differs from previous models in that the distilling section, heat exchanger, and mixing chamber are all manufactured from plastic, in this example, mainly from Araldite epoxy.

In an article entitled "Insertable dilution refrigerator for characterization of mesoscopic samples" in Cryogenics 1994, Vol. 34, No. 10, pp. 843–845, Pekola and Kauppinen describe quite accurately the construction and operation of a dilution refrigerator according to the introduction. A dilution refrigerator made essentially completely of plastic offers certain advantages. In particular, the heating effect of the eddy current arising from a varying magnetic field is avoided. The dominant factor in the heat exchanger at temperatures below 1K is the thermal boundary resistance, i.e. the so-called Kapitza resistance, which is smaller less in plastics than in metals. The construction of the dilution refrigerator itself can be made easily leak tight by fabricating components of plastic, such that they all have equal relative thermal shrinkage.

The problem in a dilution refrigerator made completely of plastic occurs at the connection of the pumping tube, because the tube is metal, usually copper or a copper alloy, which has a coefficient of thermal expansion that differs considerably from that of plastic. Thus known dilution refrigerators made entirely of plastic have been quite delicate mechanically and are easily broken at this connection.

This invention is intended to solve the above problem.

SUMMARY OF THE INVENTION

The present invention provides dilution refrigerator equipment arranged to be installed in a DEWAR flask through its narrow neck section, and which includes a vacuum vessel with its connections, a dilution refrigerator, made essentially of plastic set inside it and supported by a metallic pumping tube, comprising an upper still and a lower mixing chamber and a heat exchanger connecting them, and in which the pumping tube is connected to the still of the dilution refrigerator. The invention is characterized in that the tube connection of the still includes an intermediate piece, separating the metallic pumping tube from the plastic structure of the still, which is made of a mixture of plastic and metal powder, to accommodate the greatly deviating thermal expansions of the connection components to one another.

In one embodiment, the greatest connection diameter of the intermediate piece and the still is in the range of 1.3–2 times the diameter of the pumping tube. The combined height, i.e. axial dimension, of the intermediate piece with the pumping tube is in the range of 1.5–2.5 times the diameter of the pumping tube. The height of the joint between the intermediate piece and the still is in the range of 0.25–0.5 times the diameter of the pumping tube.

The connection between the intermediate piece and the still consists of two cylindrical surfaces in sequence of different diameters and a ring surface connecting them.

Preferably, the metal powder used in the manufacture of the intermediate piece is principally of the same metal as the pumping tube. The pumping tube is of coppernickel alloy, the plastic material of the dilution refrigerator is epoxy, and the intermediate piece is generally 60–90% copper powder and the remainder is of epoxy plastic.

In what follows, the invention is illustrated with reference to the accompanying Figures, which show one dilution refrigerator according to the invention.

DETAILED DESCRIPTION OF THE INVENTION

Figure 1:
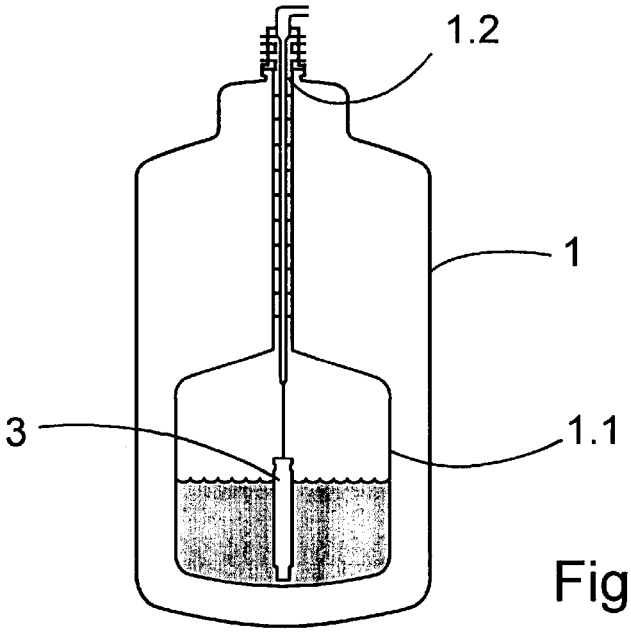
FIG. 1 shows the installation of the dilution refrigerator equipment in a DEWAR flask.

Referring now to the drawings in detail, dilution refrigerator equipment 3 has been designed to be installed in a conventional DEWAR flask 1. With its connections, the equipment forms a narrow and high construction, which can be lowered into the vessel 1.1, which is surrounded by a vacuum, FIG. 1, through the neck section 1.2 of the DEWAR flask 1. The helium connections coming from the dilution refrigerator are connected to a pump, to circulate the helium gas, mainly the He3 component.

Figure 2:
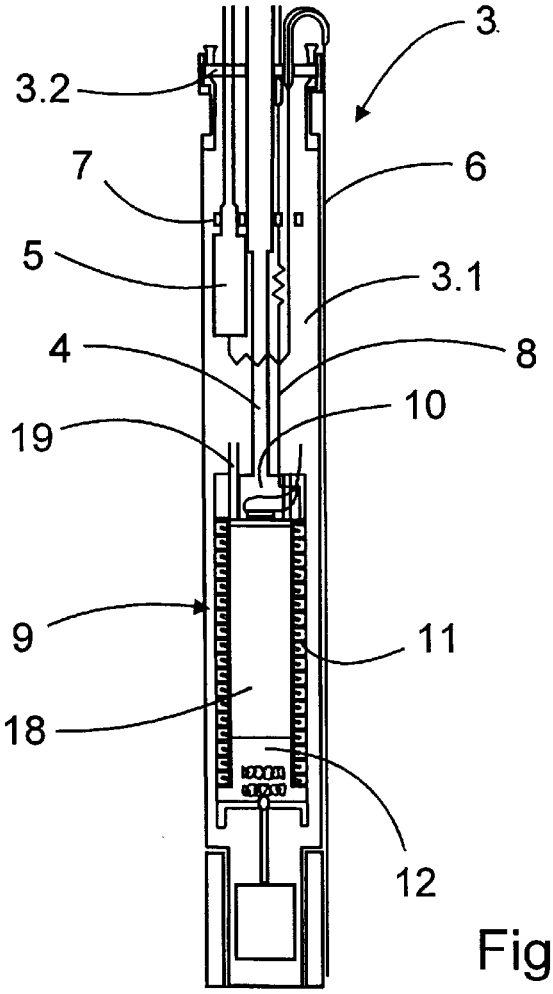
FIG. 2 shows a cross-section of the dilution refrigerator equipment.

The dilution refrigerator equipment 3 comprises a pre-refrigeration section and the actual completely plastic dilution refrigerator 9, FIG. 2, packed in a separate vacuum vessel 6. In the pre-refrigeration section, the He3 gas returning from the pump is refrigerated to 4K and 1K in plates 3.2 and 7. The dilution refrigerator 9 with the experimental samples hangs on the metallic pumping tube 4. The pumping tube 4 is made of a copper-nickel alloy, due to its poor thermal conductivity, while the plastic material of the dilution refrigerator 9 is epoxy plastic formed from a two-component glue (Stycast 1266, manufactured by Grace N.V., Westerlo, Belgium).

Plate 3.2 forms a cover for the cylindrical vacuum vessel 6, in which there are feed-throughs for the helium pipes, the pumping tube of the vessel, and the electrical cables needed for the measurement electronics. All the feed-throughs must be completely sealed to maintain the vacuum. The actual pre-refrigeration takes place in the 1K plate 7, which is cooled by the 1K evaporation pot 5.

The dilution refrigerator 9 includes a still 10, a heat exchanger 11, and a mixing chamber 12. Their construction and operation are described thoroughly in the aforementioned publication. The heat exchanger 11 is of cylindrical construction and there is a vacuum space 18 formed inside it, which is maintained by channel 19. A spiral flow channel, through which capillary tube 8 is also led, runs around the outside of the heat exchanger 11. The capillary tube 8 made of teflon-plastic leads the returning He3 liquid to the mixing chamber 12. He3 gas is sucked along the spiral flow channel from the mixing chamber 12 to the still 10, so that it cools the returning He3 flow. Phase separation of the He4/He4 mixture into two components takes place in a known manner in the mixing chamber 12, while the pumping of the He3 atoms across the phase boundary binds energy and creates refrigeration.

The structural components of the dilution refrigerator are each machined from a piece of hardened epoxy.

Figure 3:
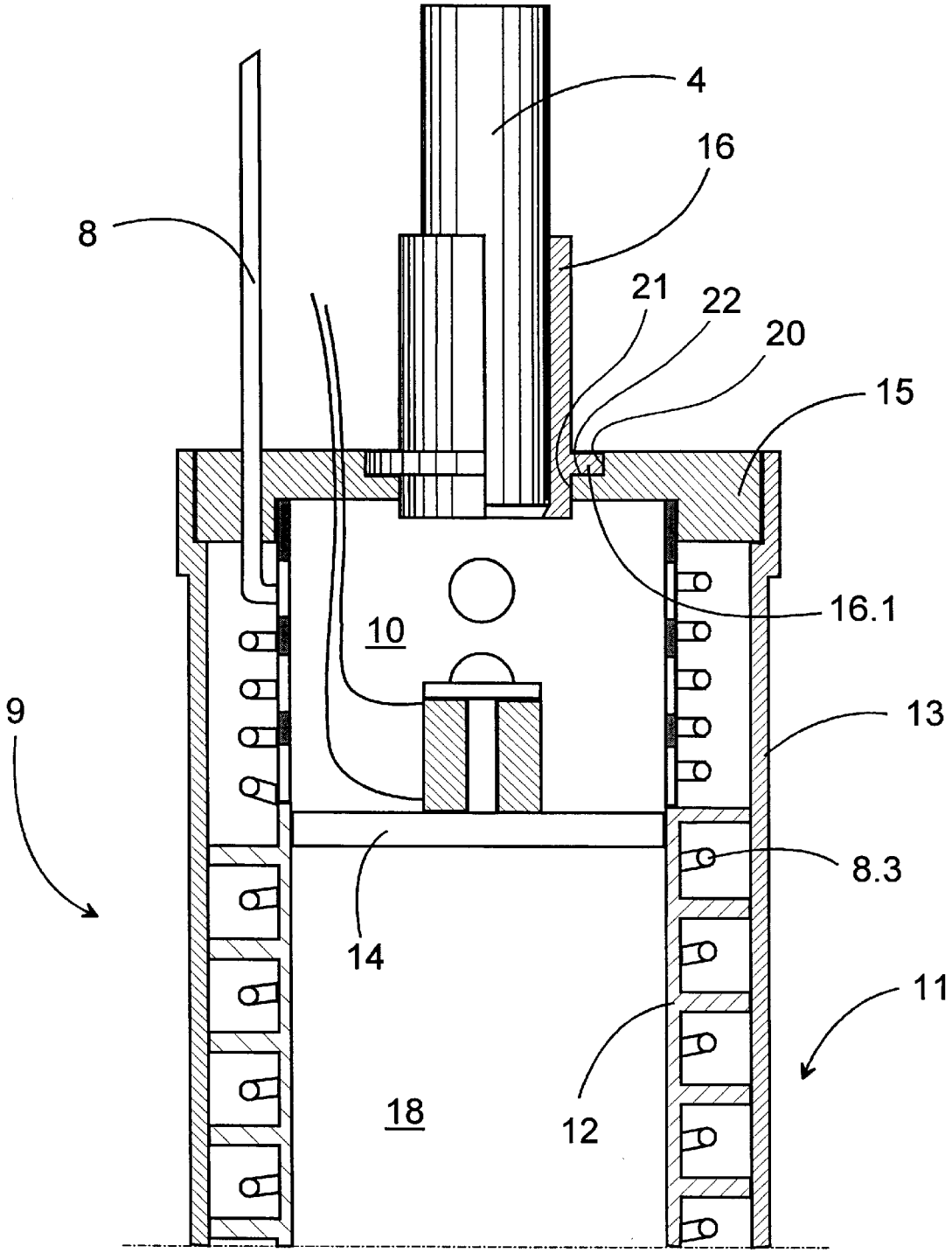
FIG. 3 shows the cross section of the upper part of the actual dilution refrigerator.

Because the coefficient of thermal expansion of plastics differs greatly from that of metals, the support point of the dilution refrigerator 9 from the pumping tube 4 is a highly critical place. When a metal tube, here a Ø 6 mm copper-nickel tube with a wall thickness of 0.1 mm, is refrigerated to a very low temperature, here less than 1K, it shrinks 0.2–0.4%. Under the same circumstances, Stycast epoxy shrinks, however, 1.2% FIG. 3 shows details of the construction, by means of which this problem is solved. Cover 15 forms the cover of the upper section 9 of the dilution refrigerator and of the still 10. It is attached to the pumping tube 4 by means of a special intermediate piece 16. In intermediate piece 16, there is a flange 16.1 to increase the sealing surface, which also forms the largest connection diameter.

The intermediate piece is manufactured from metal powder and cast epoxy plastic as a homogenous mixture. In this example, the intermediate piece 16 is made from copper powder, share 70% (60–90%) and Stycast epoxy plastic. The powder and the two-component glue are mixed to become a homogenous mass. After hardening, the intermediate piece can be machined in the same way as the other structural components.

To achieve good thermal expansion adaptivity, the following dimensions are used. The largest connection diameter of the intermediate piece 16 and the still 10 is 1.3–2 times the diameter of pumping tube 4. The combined height, i.e. the axial dimension, of the intermediate piece 16 and the pumping tube 4 is 1.5–2.5 times the diameter of the pumping tube 4. The height of the connection between the intermediate piece 16 and the still 10, i.e. the axial dimension, is 0.25–0.5 times the diameter of the pumping tube 4. The connection between the intermediate piece 16 and the still 10 consists of two cylindrical surfaces 20, 21 with different diameters in sequence axially and a ring surface 22 connecting them.

The structural components of the dilution refrigerator 3 are, such as the outer cylinder 13, the inner cylinder 12 containing the flow spiral, the cover 15 and the base 14 of the still 10, and the critical intermediate piece 16, are glued to one another using the same epoxy glue of which they are made. The same glue is also used to seal the capillary tube and the feed-throughs for electrical connection.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. Dilution refrigerator equipment for mounting in a DEWAR flask;

said flask including a vacuum vessel having connections and a narrow neck section through which a dilution refrigerator is installed into said flask;

said equipment including a generally plastic dilution refrigerator and a metallic pumping tube supporting said refrigerator in said vacuum vessel;

said dilution refrigerator including an upper still, a heat exchanger and a lower mixing chamber; and said pumping tube being connected to said still;

said dilution refrigeration equipment characterized by a tubular intermediate piece connecting said metallic pumping tube and said upper still;

said intermediate piece comprising plastic and metal powder, to accommodate the thermal expansion of the metallic pumping tube relative to said upper still.

2. Dilution refrigerator equipment as in claim 1, characterized in that said tubular intermediate piece fits over said pumping tube;

said tubular intermediate piece including a flange sealable in said upper still; and said flange having a diameter in the range of 1.3–2 times the diameter of said pumping tube.

3. Dilution refrigerator equipment as in claim 1, characterized in that said tubular intermediate piece has a length in the range of 1.5–2.5 times the diameter of said pumping tube.

4. Dilution refrigerator equipment as in claim 1, characterized in that said intermediate piece and said still have an engagement length in the range of 0.25–0.5 times the diameter of said pumping tube.

5. Dilution refrigerator equipment as in claim 4, characterized in that said still includes two sequentially axially disposed cylindrical surfaces of different diameters defining a ring shaped surface therebetween.

6. Dilution refrigerator as in claim 1 characterized in that said metal powder comprises the same metal as said pumping tube.

7. Dilution refrigerator equipment as in claim 6 characterized in that said pumping tube comprises a copper-nickel alloy and said intermediate piece comprises 60–90% copper powder.

8. Dilution refrigerator equipment as in claim 7 characterized in that said intermediate piece comprises epoxy plastic.

* * * * *